US012188252B2

(12) United States Patent
Hanneken

(10) Patent No.: US 12,188,252 B2
(45) **Date of Patent: *Jan. 7, 2025**

(54) METHOD FOR SECURING A LINE TO AN EXTERNAL SURFACE, SUCH AS A FENCE POST

(71) Applicant: Chris Hanneken, Paso Robles, CA (US)

(72) Inventor: Chris Hanneken, Paso Robles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/367,933

(22) Filed: Sep. 13, 2023

(65) Prior Publication Data

US 2024/0003161 A1 Jan. 4, 2024

Related U.S. Application Data

(63) Continuation of application No. 17/986,743, filed on Nov. 14, 2022, now Pat. No. 11,773,617, and a continuation of application No. 15/631,353, filed on Jun. 23, 2017, now Pat. No. 11,525,278.

(51) Int. Cl.
*E04H 17/10* (2006.01)
*E04H 17/06* (2006.01)

(52) U.S. Cl.
CPC ..... *E04H 17/124* (2021.01); *E04H 17/06* (2013.01)

(58) Field of Classification Search
CPC ..... E04H 17/10; E04H 17/06; E04H 17/12
USPC ... 248/544, 51, 58, 60, 63, 64, 68.1, 65, 70, 248/73, 74.3, 74.4; 256/10, 48, 47
See application file for complete search history.

(56) References Cited

U.S. PATENT DOCUMENTS

| | | | |
|---|---|---|---|
| 768,598 | A | 8/1904 | Gladhill |
| 1,079,043 | A | 11/1913 | Jacob |
| 1,689,610 | A | 10/1928 | Winter |
| 1,776,887 | A | 9/1930 | Christensen |
| 1,826,182 | A | 10/1931 | Lee |
| 2,438,419 | A | 3/1948 | Schmidt |
| 2,618,685 | A | 11/1952 | Lewis |
| 2,662,740 | A | 12/1953 | White |
| 2,718,545 | A | 9/1955 | Thurman |
| 2,728,560 | A | 12/1955 | Pals, Jr. |
| 2,911,172 | A | 11/1959 | Clayton |

(Continued)

OTHER PUBLICATIONS

Hanneken; U.S. Appl. No. 15/631,353, filed Jun. 23, 2017.

(Continued)

*Primary Examiner* — Christopher Garft
*Assistant Examiner* — Michael McDuffie
(74) *Attorney, Agent, or Firm* — Fitch, Even, Tabin & Flannery LLP

(57) ABSTRACT

An article for securing a line to an external surface, such as a fence post, includes a spiral member having a first end and a second end. The first end is adapted to be secured to the external surface. The spiral member has a curved portion extending from the first end. The curved portion has an exterior surface. The second end has an outer surface that overlies in spaced relation the exterior surface of the curved portion. The space between the exterior surface of the curved portion and the outer surface of the second end having a distance that is greater than a diameter or thickness of the line. The spiral member has a circular cross-section. The curved portion extends for greater than 360°.

9 Claims, 3 Drawing Sheets

(56) References Cited

U.S. PATENT DOCUMENTS

| | | | | |
|---|---|---|---|---|
| 3,154,275 | A | 10/1964 | Stewart | |
| 3,204,908 | A | 9/1965 | Brown | |
| 3,411,754 | A | 11/1968 | Fahrenholz | |
| 3,568,980 | A | 3/1971 | Hulburt | |
| 3,633,252 | A | 1/1972 | Williams | |
| 3,671,017 | A | 6/1972 | Sachs | |
| 3,883,934 | A | 5/1975 | Rochfort | |
| 3,990,454 | A | 11/1976 | Schlesinger | |
| 4,097,015 | A | 6/1978 | Frishman | |
| 4,150,814 | A | 4/1979 | Warren | |
| 4,595,176 | A | 6/1986 | Crabtree | |
| 4,856,739 | A | 8/1989 | Takikawa | |
| 4,893,788 | A | 1/1990 | Chave | |
| 5,141,192 | A | 8/1992 | Adams | |
| 5,350,155 | A | 9/1994 | Burk | |
| D357,624 | S | 4/1995 | Ferdman | |
| 5,664,768 | A | 9/1997 | Scabar | |
| 5,921,402 | A | 7/1999 | Magenheimer | |
| 6,494,411 | B1 | 12/2002 | Bjorklund | |
| D470,034 | S | 2/2003 | Wu | |
| 6,629,675 | B1 | 10/2003 | Bjorklund | |
| 6,695,293 | B1 | 2/2004 | Kamarad | |
| 7,014,153 | B2 | 3/2006 | Helot | |
| 7,739,775 | B2 | 6/2010 | Shimanski | |
| 7,895,716 | B2 | 3/2011 | Taillon | |
| 8,147,102 | B1 | 4/2012 | Townes | |
| 8,985,528 | B2 | 3/2015 | Colvin | |
| 11,525,278 | B2 * | 12/2022 | Hanneken | E04H 17/124 |
| 11,773,617 | B2 * | 10/2023 | Hanneken | E04H 17/124 248/68.1 |
| 2003/0097735 | A1 | 5/2003 | Shore | |
| 2012/0032035 | A1 | 2/2012 | Burrows | |
| 2013/0328000 | A1 | 12/2013 | Hendricks | |
| 2018/0371787 | A1 | 12/2018 | Hanneken | |
| 2023/0076016 | A1 | 3/2023 | Hanneken | |

OTHER PUBLICATIONS

Hanneken; U.S. Appl. No. 17/986,743, filed Nov. 14, 2022.

USPTO; Decision on Appeal issued in U.S. Appl. No. 15/631,353 mailed Jul. 7, 2022.

USPTO; Examiner Interview Summary issued in U.S. Appl. No. 15/631,353 mailed Aug. 11, 2020.

USPTO; Examiner's Answer issued in U.S. Appl. No. 16/631,353 mailed Sep. 22, 2021.

USPTO; Final Office Action issued in U.S. Appl. No. 15/631,353 mailed Jul. 3, 2018.

USPTO; Final Office Action issued in U.S. Appl. No. 15/631,353 mailed Nov. 25, 2020.

USPTO; Non-Final Office Action issued in U.S. Appl. No. 15/631,353 mailed Apr. 27, 2020.

USPTO; Non-final Office Action issued in U.S. Appl. No. 15/631,353 mailed Dec. 28, 2017.

USPTO; Non-Final Office Action issued in U.S. Appl. No. 17/986,743 mailed Mar. 7, 2023.

USPTO; Notice of Allowance issued in U.S. Appl. No. 17/986,743 mailed Jun. 5, 2023.

USPTO: Notice of Allowance issued in U.S. Appl. No. 15/631,353 mailed Aug. 15, 2022.

* cited by examiner

METHOD FOR SECURING A LINE TO AN EXTERNAL SURFACE, SUCH AS A FENCE POST

CROSS-REFERENCE TO RELATED APPLICATIONS

This application is a continuation of U.S. application Ser. No. 17/986,743, filed Nov. 14, 2022, for ARTICLE, ASSEMBLY AND METHOD FOR SECURING A LINE TO AN EXTERNAL SURFACE, SUCH AS A FENCE POST, which is a continuation of U.S. application Ser. No. 15/631,353, filed Jun. 23, 2017, now U.S. Pat. No. 11,525,278, for ARTICLE, ASSEMBLY AND METHOD FOR SECURING A LINE TO AN EXTERNAL SURFACE, SUCH AS A FENCE POST, both of which are incorporated in their entirety herein by reference.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to attachment articles. More particularly, the present invention relates to articles that are able to connect a line to an external surface. More particularly, the present invention relates to attachment devices for securing a wire to a fence post.

2. Description of Related Art Including Information Disclosed Under 37 CFR 1.97 and 37 CFR 1.98

Wire fences of all types are utilized in the agricultural industry. A few examples of wire fences include barbed wire fences and electric wire fences. In agricultural settings, wire fencing, due to its relatively low expense and its relatively high strength and restraining properties, is often used for constructing fences for containing animals (e.g. cattle) within large areas (e.g. pastures). Further, compared to other fencing options, wire fences are relatively easy to construct, while requiring a minimal amount of equipment. This equipment can include fenceposts, wires, wire fasteners, and fence staples.

In a typical constructed wire fence, multiple strands of wire can be aligned under tension between heavily braced fenceposts. The strands of wire can be held at or near a desired height along the entire span of the fence by being attached to a series of lined posts which are located between and generally co-linear with the end posts. For example, the strands can be spaced apart from each other such that the top strand of the wire fence is held at or near a height which is proximal to the upper ends of the fence posts along the entire span of the fence, while the bottom strand of the wire fence is held at a height which is proximal to the ground-level along the entire span of the fence, thereby allowing the multiple strands to cover the vertical area extending from the tops of the posts to the ground level. Currently, wire fasteners are used to tightly secure the wire between the wire fastener and the line posts in such a manner so as to maintain each wire at its correct height along the entire span of the fence and restrict movement of each strand in the horizontal and vertical directions.

Over time, one or more strands of wire can begin to sag in some places along the fence, thereby providing an indication that the tension on the particular strand of wire has to be adjusted in order to reposition the strand to its correct height relative to the fence post. In other instances, breaks in the wire can occur at points where the wire fastener secures the wire to the line post. Due to the movement restraint of the wire caused by currently available wire fasteners, the wire fasteners typically need to be removed before the strand wire can be repaired, moved and/or tightened. For example, currently available wire fasteners do not provide clearance between the line post and the fastener to allow the strand of wire to move freely along the fence line to allow for proper height adjustment and/or tightening of the wire. As such, when a force is applied to the wire, the wire is restricted from movement and held fast to the post by the fastener. Further, currently available wire fasteners, in order to limit the inward/outward movement of the strands, can be connected to the line posts in such a manner so as to pin or trap the wire against the line post. This can result in an accelerated rusting of the wire (since moisture tends to collect at or near these contact points between the wire and the fastener) resulting in a shortened lifespan for the wire. Further, because the currently available wire fasteners are designed to tightly pinched the wire between the fastener and the line post, the currently available wire fasteners can cause the wire to degrade or weaken at the contact point thereby shortening the life span of the wire fencing.

Additionally, currently available wire fasteners require a great deal of effort in order to secure the line to the line post. As such, the installation of fences can be quite time-consuming. As a result, there is a need to provide a fastener whereby the wire fencing can be installed onto the fence in a simple, quick and convenient manner. Additionally, when it is necessary to remove the wire fencing, the wire fastener should have a quality so that the wire can be easily removed from and replaced onto the fastener.

In the past, various patents have issued relating to wire fasteners. For example, U.S. Pat. No. 768,598, issued on Aug. 30, 1904 to T. W. Gladhill, describes an attachment for securing wires to fenceposts. The attachment comprises a securing member having a shank provided with an angularly-disposed head projected upwardly from one end thereof. The opposite end of the shank is transversely widened and provided transversely thereof with openings to receive a fence wire. A slot is angularly disposed and out-of-alignment relative to the opening and leading from the upper surface of the widened portion of the shank to the transverse opening. The slot provides an entrance for the introduction of wire into the opening and forms lips at diagonally opposite portions of the slotted part of the shank.

U.S. Pat. No. 1,079,043, issued on Nov. 18, 1913 to J. Fisher, describes a fence wire fastener for fence post. The fastener comprises a vertical series of brackets in which each bracket has spaced upper and lower ears and a connecting portion fitted against the post. A fastening device secures the brackets to the post. A vertical rod extends through the ears and has its upper terminal portion bent to form a top loop or head. The vertical rod also has a terminal locking portion extended through the ears of the top bracket and adapted to be bent beneath the lower ear thereof to prevent withdrawal of the rod.

U.S. Pat. No. 1,776,887, issued on Sep. 30, 1930 to P. M. Christensen, teaches a wire fastener for use with a fence post having a wire receiving notch formed therein. The fastener is formed from a single strand of wire and has an intermediate portion thereof extending through an opening in the post above the notch. One end portion of the wire is bent at substantially right angles to the intermediate portion of the wire for disposition across the notch. The opposite end is bent at right angles to the intermediate portion to provide a wire fence retaining part adapted to extend across the notch on the opposite sides of the fence post. The intermediate portion of the wire provides a pivot for the fastening device.

U.S. Pat. No. 1,826,182, issued on Oct. 30, 1931 to D. C. Lee, shows a wire mounting fencepost having upper and lower openings whose axes are transverse to the direction in which the wire extends. A wire fastening clip is provided having a pivot hook at one end to engage one of the openings. The other end of the clip has a cam adapted to snap through the other opening when the clip is forcibly swung in the operative position. The cam and the post are cooperative to momentarily spring the clip from its normal shape and the clip is forced into position and being thereafter cooperative so as to hold the clip in place.

U.S. Pat. No. 2,662,740, issued on Dec. 15, 1953 the W. E. White, describes a resilient clip for attaching line wires to U-shape fenceposts having vertically spaced central holes. The clip includes an elongated shank portion an angularly bent portion adapted to be inserted through a hole and pressed tightly against the rear face of the post, a line wire retaining portion intermediate the shank and offset portions, and a terminal portion adapted to engage one side of the post.

U.S. Pat. No. 2,728,560, issued on Dec. 27, 1955 to H. Pales, shows a fencepost and a means for attaching wire strands thereto. The means for attaching wire strands includes a plurality of spaced-apart pairs of horizontal ear flanges on the face of the post. Each of the pairs of ear flanges has an elongated protrusion area at one side thereof. A vertical pin is slidably detachably extended through the elongated protrusion area of each pair of ear flanges respectively. The pairs of ear flanges are alternately reversed relative to each other to alternately bring the pins first to one side of the vertical center of the face of the post and then to the other side of the vertical center of the post.

U.S. Pat. No. 3,411,754, issued on Nov. 19, 1968 to M. H. Fahrenholz, shows a wire fastener for a fence post that includes horizontally spaced-apart clips defining generally vertically-disposed oppositely opening slots. The slots in the clips have closed ends in substantial horizontal alignment and vertically-spaced entrance passages. The entrance passages are disposed in vertically-spaced relation so that one of the clips holds the wire up in a locking position and the other of the clips holds the wire down in a locking position against accidental dislodgment.

U.S. Pat. No. 5,350,155, issued on Sep. 27, 1994 to L. E. Burk, provides a wire holding fence post attachment assembly having a main strand support and connector member mountable on a fence post and operable with a strand restraining member. The main strand support and connector member includes a central body member integral with outer connector flange sections. The central body member is provided with strand receiving openings and cooperating lock pin receiving projections. The strand receiving openings are provided with outer tab sections that contact barbwire strands and prevent the same from snagging with barb members thereon. The cooperating lock pin receiving projections are provided with openings therein to releasably receive the strand restraining member therein to keep the barbed wire sections from moving outwardly from respective ones of the strand receiving openings.

U.S. Pat. No. 6,695,293, issued on Feb. 24, 2004 to Kamarad et al., teaches a metal fence post with quick connections used for securing a portion of the fence wire next to the fence post. The metal fence post includes a plurality of equally-spaced oblique studs disposed along the length of one side of the post. An equally-spaced wire gap is provided between each of the studs. The wire gap is dimensioned for receiving a portion of the fence wire therein. Each of the oblique studs has a side profile of a trapezoidal geometric shape with a vertical base integrally attached to the side of the post and a parallel vertical top. An upper side and a lower side of the trapezoidal oblique stud is angled upwardly and inwardly from the base toward the top. In each of the studs is a vertical locking pin hole with an upper opening in the upper side and a lower opening in the lower side. The locking pin holes are parallel and indexed with each other for receiving the locking pin therethrough and holding the wire in the wired gap.

U.S. Patent Application Publication No. 2013/0328000, published on Dec. 12, 2013 to R. L. Hendricks, discloses a clip for connecting a strand of wire fencing to a line post of a fence. The clip includes an aperture for receiving the wire to facilitate movement of the wire when the clip is coupled to the line post.

It is an object of the present invention to provide a line securing article that facilitates the ability to connect a line to an external surface.

It is another object of the present invention to provide a line securing article which, in particular, allows a fence wire to be removably secured to a fence post.

It is another object of the present invention to provide a line securing article which allows for relative movement of the line with respect to the external surface.

It is another object of the present invention to provide a line securing article which can be easily secured to the external surface.

It is still another object of the present invention to provide a line securing article which spaces the line from the external surface.

It is still further object of the present invention to provide a line security article which is easy to use, relatively inexpensive and easy to manufacture.

These and other objects and advantages of the present invention will become apparent from a reading of the attached specification and appended claims.

BRIEF SUMMARY OF THE INVENTION

The present invention is an article for securing a line between external surface. As used herein, the line can include wires, ropes, strings, flexible conduits, and flexible pipes. "external surface" can include a variety of surfaces and, in particular, fence posts.

The article for securing lines comprises a spiral member having a first end and a second end. The first end is adapted to be secured to the external surface. The spiral member has a curved portion extending from the first end. The curved portion has an exterior surface. The second end has an outer surface that overlies in spaced relation to the exterior surface of the curved portion. The space between the exterior surface of the curved portion and the outer surface of the second end has a distance that is greater than a diameter a thickness of the line.

In the present invention, the spiral member has a circular cross-section. The first end has a linear portion extending to the curved portion. The curved portion extends for greater than 360°. The second end has an end surface that faces upwardly. The circular cross-section has a diameter greater than the diameter or thickness of the wire.

In the embodiment of the article of the present invention, a mounting surface is affixed to the first end of the spiral member. The mounting surface is adapted to be affixed to the external surface. In particular, the mounting surface is a plate. The first end is welded directly to a face of the plate. The spiral member extends transversely outwardly of the face of the plate. The line is, in particular, a wire or a bundle of wires.

The present invention is also an assembly that comprises an external surface, a spiral member affixed to the external surface, and a line extending through an interior of the spiral member. The spiral member has a first end and a second end. The first end is secured to the external surface. The spiral member has a curved portion extending from the first end. The second end has an outer surface that overlies in spaced relation to the exterior surface of the curved portion. The space between the exterior surface of the curved portion and the outer surface of the second end has a distance that is greater than a diameter or thickness of the line. In this assembly, the external surface can be a fence post. The line can be a wire or a bundle of wires.

In this assembly, a mounting surface is affixed to the first end of the spiral member. The mounting surface is affixed to the external surface. The mounting surface is a plate. The first end is welded directly to a face of the plate. The spiral member extends transversely outwardly of the face of the plate. The spiral member has a circular cross-section. The first end has a linear portion extending to the curved portion. This linear portion is connected or interconnected to the external surface. The curved portion extends for greater than 360°.

The present invention is also a method of connecting a line to an external surface. This method comprises the steps of: (1) forming a spiral member; (2) affixing the spiral member to the external surface; and (3) extending the line between the exterior surface of the curved portion and the outer surface of the second end of the curved portion such that the line resides in an interior of the spiral member. In this method, the first end and the spiral member is affixed to a mounting surface. The mounting surface is then attached to the external surface. The line can be a wire or a bundle of wires. The external surface can be a fence post.

This foregoing Section is intended to describe the preferred embodiment of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
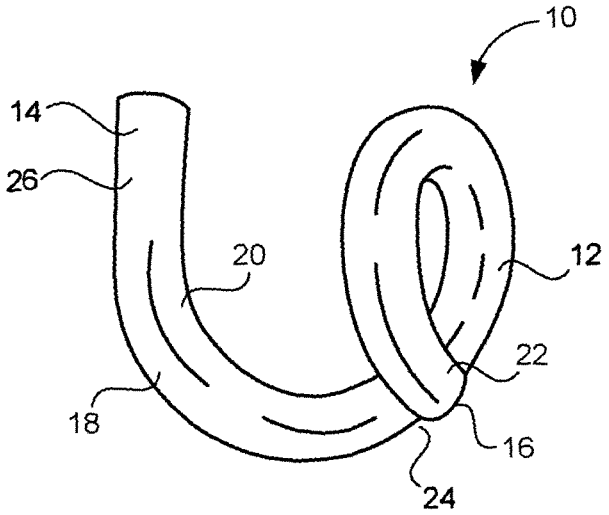
FIG. 1 is a perspective view showing the line securing article in accordance with the preferred embodiment of the present invention.

Referring to FIG. 1, there is shown the line securing article 10 in accordance with the present invention. The line securing article 10 can be used for securing a line to an external surface. In particular, as used herein, the line is directed to a variety of structures, such as wires, electrical lines, flexible tubing, flexible piping, and other conduits. In the preferred embodiment the present invention, the line securing article 10 is particularly directed toward the securing of a fence wire to a fence post.

The line securing article 10 comprises a spiral member 12 having a first end 14 and a second end 16. The first end 14 is adapted to be secured to the external surface. The spiral member has a curved portion 18 extending from the first end 14. The curved portion 18 has an exterior surface 20. The second end 16 has an outer surface 22 that overlies and is in spaced relation with the exterior surface 20 of the curved portion 18. The space 24 between the exterior surface 20 of the curved portion 18 and the outer surface 22 of the second end 16 has a distance that is greater than a diameter or thickness of the line.

In FIG. 1, can be seen that the first end 14 has a generally linear portion 26 that extends to the curved portion 18. The curved portion 18 extends for greater than 360°.

Figure 2:
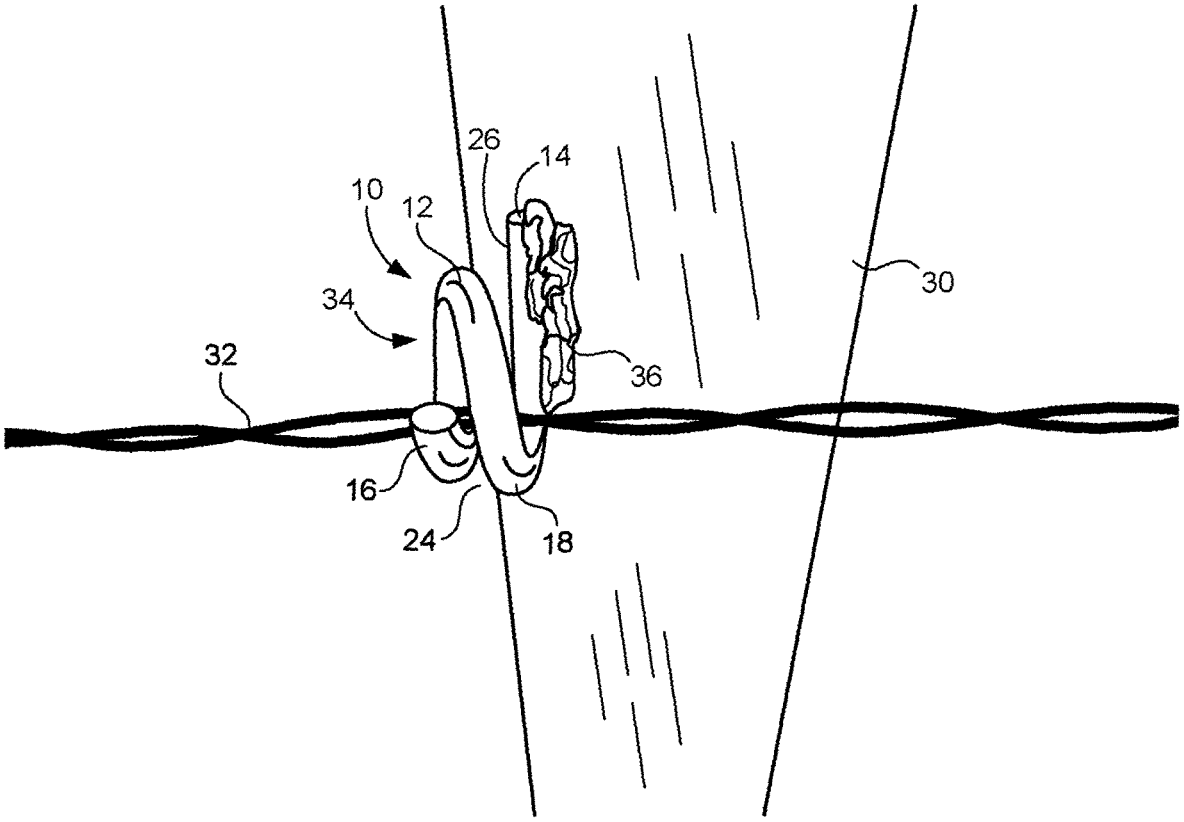
FIG. 2 is a frontal view showing the line securing article as affixed to an external surface.

FIG. 2 shows the line securing article 10 of the present invention as secured to an external surface 30. The external surface 30 is, in the preferred embodiment, a fence post. A line 32 will extend through the interior 34 of the line securing article 10. As shown in FIG. 2, the line 32 is a fence wire.

In FIG. 2, it can be seen that the space 24 between the outer surface 22 of the second end 16 and the exterior surface of the curved portion 18 has a distance that is greater than a diameter or thickness of the line 32. The linear portion 26 of the first end 14 is illustrated as affixed to the external surface 30. In particular, it can be seen that the linear portion 16 is affixed to by weld 36 to the external surface 30. When this direct welding is used, the external surface 30 would be in the nature of a metal fence post.

FIG. 2 also illustrates how it is easy to install the line 32 within the interior 34 of the line securing article 10. It is only necessary to thread the line 32 through the space 24 and then loop the line 32 through the space 24. The line 32 can then be lifted so as to be separated from the line securing article 10. Since the curved portion 18 extends for greater than 360°, the line 32 can only be removed from the line securing article 10 by a manipulative force. As such, if an animal should contact the line 32, such an manipulated contact would not cause the line 32 to separate from line securing article 10. It can be seen that the spiral member 12 has a circular cross-section, the circular cross-section will act so as to allow the user to properly "funnel" the line 32 between the exterior surface 20 of the curved portion 18 and the outer surface 22 of the second end 16. It can be seen that the second end 32 is configured so as to face upwardly. This allows the user to easily place the wire through the space 24.

The attachment of the line 32 to the external surface 30 is also achieved in a reverse manner. It is only necessary to lower the line 32 behind the curved portion 18 and then to manipulate the line 32 through the space 24. Once again, the curved outer surfaces of the line securing article 10 facilitate the ability to install the line 32 without causing it to hang up on any projections or edges.

Figure 3:
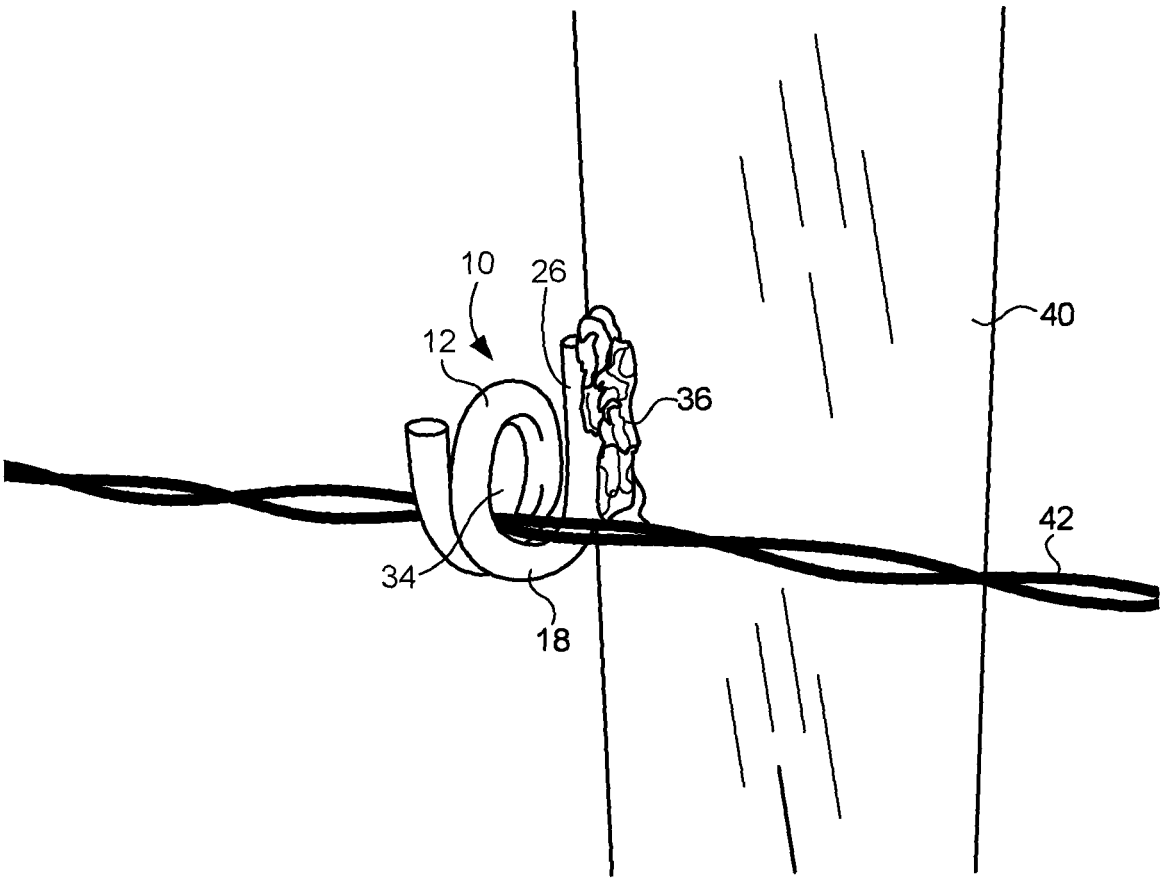
FIG. 3 is a side view showing the line securing article as secured to an external surface.

FIG. 3 is another view showing the line securing article 10 is affixed to a fence post 40. They fence post 40 is a metal fence post. As such, weld 36 affixes the linear portion 26 to the fence post 40. The fence wire 42 extends through the interior 34 of the line securing article 10. Since the spiral member 12 has its curved portion 18 extending for greater than 360°, the fence wire 42 is securely mounted within the interior 34 of the spiral member 12. Once again, removal is simple. It is only necessary to thread the fence wire 42 through the space 24. The fence wire 42 will automatically move into position.

Figure 4:
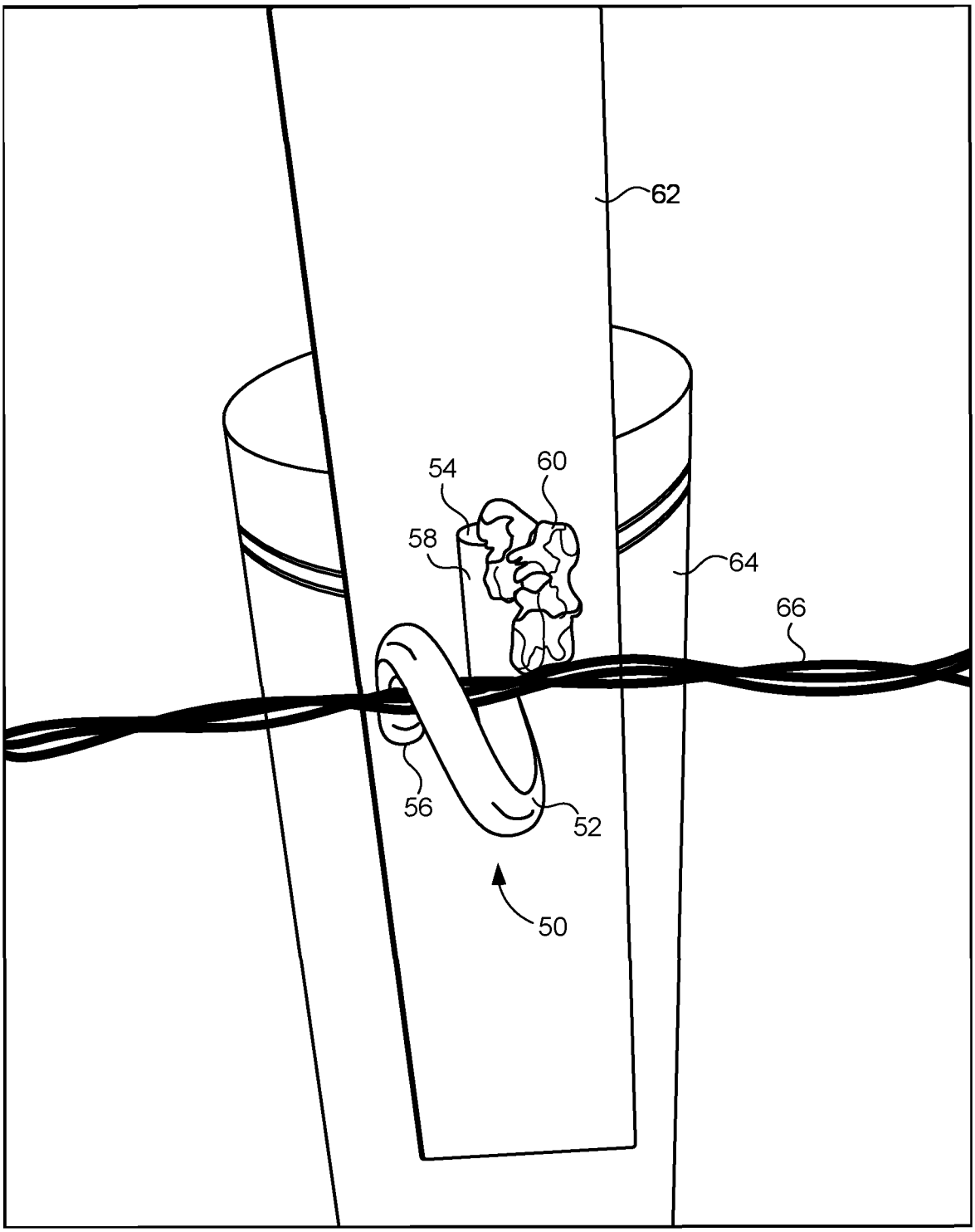
FIG. 4 shows an alternative embodiment of the line securing article of the present invention in which the line securing article is affixed to a mounting plate which, in turn, is affixed to an external surface.

FIG. 4 shows an alternative embodiment of the present invention. In FIG. 4, the line securing article 50 includes a spiral member 52 having a first end 54 and a second end 56. A linear portion 58 that the first end 54 is affixed by weld 60 to a mounting surface 62. The mounting surface 62 is a metal plate. The mounting surface 62 can then be secured by various means to the external surface 64. In FIG. 4, the external surface 64 is a round post. The line 66 is simply removed by pulling the line 66 downwardly so as to free the line 66 from the second end 56, and then lifting the line 66 from the line securing article 50.

The line securing article 10 of the present invention has the interior 34 that receives the strand of wire so as to facilitate movement of the wire when the line securing article 10 is coupled to the external surface 30. The line securing article 10 and the interior 34 associated with the line securing article 10 facilitates a separation between the wire and the post. This allows some inward and outward movement of the strand of wire relative to the fenced-in area. This means that the strand wire can move toward and away from the post and parallel to the ground. As such, it provides some spring-like flexibility to the fence along the entire span of the fence by promoting the avoidance of wire degradation and rusting issues associated with currently available wire fasteners. The line securing article 10 and its interior 34 also provide sufficient space to allow for omni-directional movement (i.e. up-and-down movement, side-to-side movement, and movement along the fence line toward the end post) of the stranded wire. This allows the wire to be moved, repaired and/or tightened, or to take the slack out of the wire so that the wire to be positioned and/or repositioned at the desired height without having to loosen or detach the line securing article from the external surface. The line securing article 10 and its interior 34 also promotes the ability to maintain the strand of wire at or near a desired height and/or distance relative to the fence post, the ground, and other strands of wire of the fence. Furthermore, the line securing article 10 can be configured for use with various types of wire fences. For example, the size of the interior 34 can be configured to allow clearance for barbs of a barb wire fence. Also, one or more portions of the line securing article 10 can be coated with an electrical insulating material to reduce the likelihood of shorts with an electrical fence. Moreover, the interior 34 can be configured to receive an electrical insulating member such as an insulated insert to reduce shorting of the electrical fence.

The foregoing disclosure and description of the invention is illustrative and explanatory thereof. Various changes in the details of the illustrated construction and in the steps of the described method can be made within the scope of the present claims without departing from the true spirit of the invention. The present invention should only be limited by the following claims and their legal equivalents.

What is claimed is:

1. A method of using a spiral member attached to an external surface to secure a line to the external surface, comprising the steps of:

for the spiral member having a first end and a second end, the first end having a linear portion affixed to the external surface such that a cross-section of the first end faces upwardly, the spiral member having a curved portion extending from the linear portion of the first end, the curved portion having an exterior surface, the second end having an end surface across a cross-section thereof facing upwardly and having an outer surface that overlies in spaced relation to said exterior surface of said curved portion, thus forming a space between the second end and the curved portion, threading the line through the space;

looping the line through the space; and lifting the line so as to be separated from the spiral member.

2. The method of claim 1, wherein the space has a distance that is greater than a diameter or thickness of the line.

3. The method of claim 2, wherein the line is a wire or a bundle of wires.

4. The method of claim 1, wherein the affixing of the linear portion to the external surface comprises a mounting surface affixed to said linear portion of the first end of the spiral member, and the mounting surface being affixed to the external surface.

5. The method of claim 4, wherein the mounting surface is a plate, wherein the linear portion of the first end of the spiral member being welded directly to a face of the plate, the spiral member extending transversely outwardly of the face of the plate.

6. The method of claim 1, wherein the spiral member has a circular cross-section.

7. The method of claim 1, wherein the curved portion extends for greater than 360°.

8. The method of claim 1, wherein the external surface is a fence post.

9. The method of claim 8, wherein the fence post is a metal fence post.

* * * * *